US007186172B1

(12) United States Patent
Ohata

(10) Patent No.: US 7,186,172 B1
(45) Date of Patent: Mar. 6, 2007

(54) SPRING FORCE ADAPTER FOR ROUND BLADE FOR A GRINDER

(75) Inventor: Shinji Ohata, Hiroshima (JP)

(73) Assignee: Nao Enterprise, Inc., Oakland, NJ (US)

( * ) Notice: Subject to any disclaimer, the term of this patent is extended or adjusted under 35 U.S.C. 154(b) by 0 days.

(21) Appl. No.: 11/434,402

(22) Filed: May 15, 2006

(51) Int. Cl.
*B24B 41/00* (2006.01)
*B24B 23/00* (2006.01)

(52) U.S. Cl. ..... 451/342; 451/508; 451/514

(58) Field of Classification Search ..... 451/342, 451/343, 357, 360, 508, 510, 514; 408/239 R
See application file for complete search history.

(56) References Cited

U.S. PATENT DOCUMENTS 5,319,886 A * 6/1994 Steere, Jr. ..... 451/342
6,340,022 B1 * 1/2002 Schroer ..... 125/13.01
6,893,335 B2 * 5/2005 MacKay ..... 451/359

* cited by examiner

*Primary Examiner*—Jacob K. Ackun, Jr.
(74) *Attorney, Agent, or Firm*—Schweitzer Cornman Gross & Bondell, LLP

(57) ABSTRACT

A blade-mounting adaptor for a power tool has a blade-mounting stud on which the blade is mounted at a first end. The blade is mounted upon the stud in a manner such that it is capable of axial motion along the length of the stud when exertion is applied to the blade. The blade is provided with an adjustable pre-set bias force against the axial motion.

12 Claims, 4 Drawing Sheets

SPRING FORCE ADAPTER FOR ROUND BLADE FOR A GRINDER

This invention relates to a spring force adapter for coupling a round cutting tool or the like, such as a grinder blade, to a power tool such as an electric grinder.

BACKGROUND OF THE INVENTION

Blades used in tools such as electric grinders are utilized in a variety of applications where precise control of the tool may be required. Such applications include shaving mortar or concrete adhering to old bricks, tiles, concrete or frames and have the objective of removing such foreign matter from the substrate evenly and completely without damaging the substrate. As the grinder blade is engaged with the surface significant loading of the tool can result. The application of excessive force by the tool operator can result in overloading the tool, resulting in excessive current draw, overheating, excessive wear to tool components, or failure.

Such grinders generate significant amounts of dust and debris during operation. As a result of increasingly strict health and environmental regulations and concerns, the grinders often are provided with a safety cover or shield to contain or restrain the dust and debris, along with a vacuum device to collect the materials. Often the safety cover or shield has a mechanism, such as brushes, to provide a measure of a seal between the cover and the workpiece. The blade must be positioned appropriately with respect to the seal to allow appropriate contact with the workpiece to be made while brush contact is preserved.

The blades utilized in connection with the grinders and similar tools are interchangeable and replaceable. It is thus important that each blade when mounted on the tool is positioned properly with respect to the cover or shield to permit proper blade-workpiece contact to be maintained as blades are exchanged and replaced. As grinding is a force-intensive action, sufficient force must be applied to the tool to maintain appropriate contact between the rotating grinding wheel and the workpiece, but not excessive force that can stress or overload either the tool motor or grinding wheel.

It is accordingly the objective of the present invention to provide a coupling for the mounting of a grinder blade or similar rotating tool that can minimize or eliminate damage to the electrical tool due to repetitive and rapid changes in the load or heavy loads and which accommodates the necessary blade positioning for proper and efficient tool operation.

BRIEF DESCRIPTION OF THE INVENTION

In accordance with the foregoing and other objectives the present invention is a coupling upon which a grinder blade or other rotating tool element is mounted and which in turn is mounted to the tool drive shaft. The blade is spring biased into an operating position at the end of the coupler shaft. Thus the position of the blade with respect to the tool remains constant when blades are changed. Excessive axial forces applied to the blade, such as by the operator pushing the blade into a workpiece, overcome the spring force applied to the blade, allowing the blade to retract along the coupler, relieving the force on the blade. As the excessive force is removed the blade returns to the original position. The level of spring bias is adjustable.

BRIEF DESCRIPTION OF THE FIGURES

A fuller understanding of the invention will be achieved upon consideration of the following detailed description of a preferred but nonetheless illustrative embodiment thereof, when considered in conjunction with the annexed drawings, wherein.

DETAILED DESCRIPTION OF THE INVENTION

Figure 1:
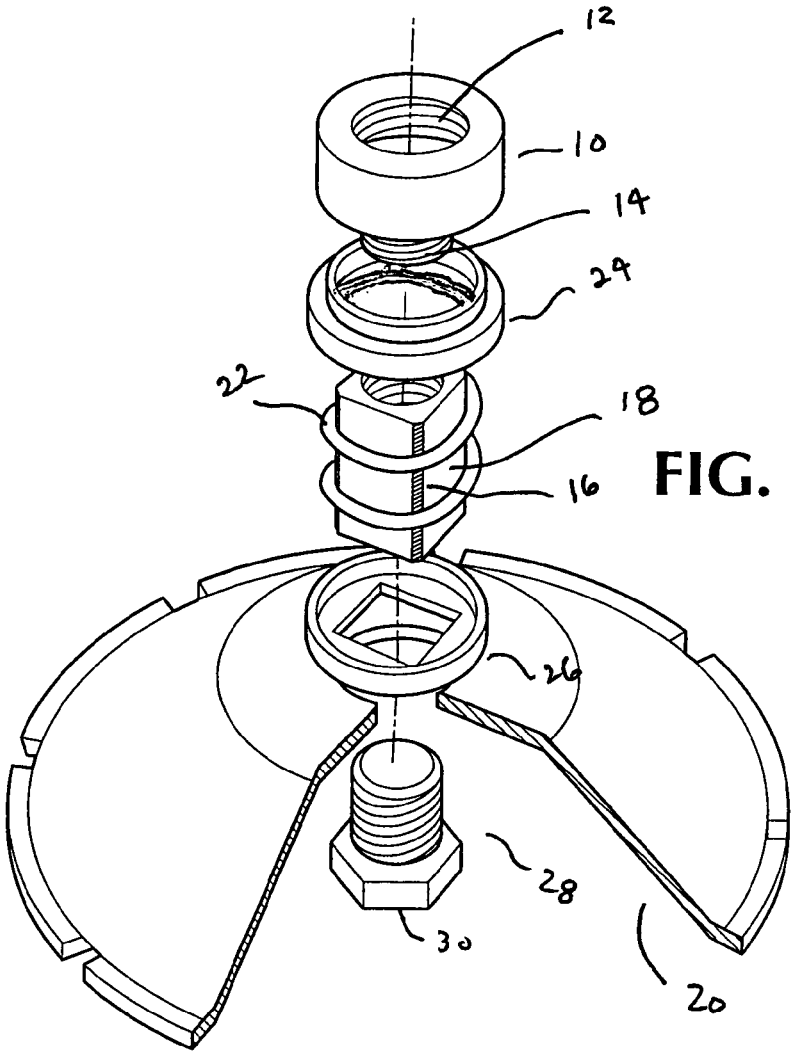
FIG. 1 is an exploded perspective assembly diagram showing an embodiment of the present invention and a blade as installed thereon.
Figure 2:
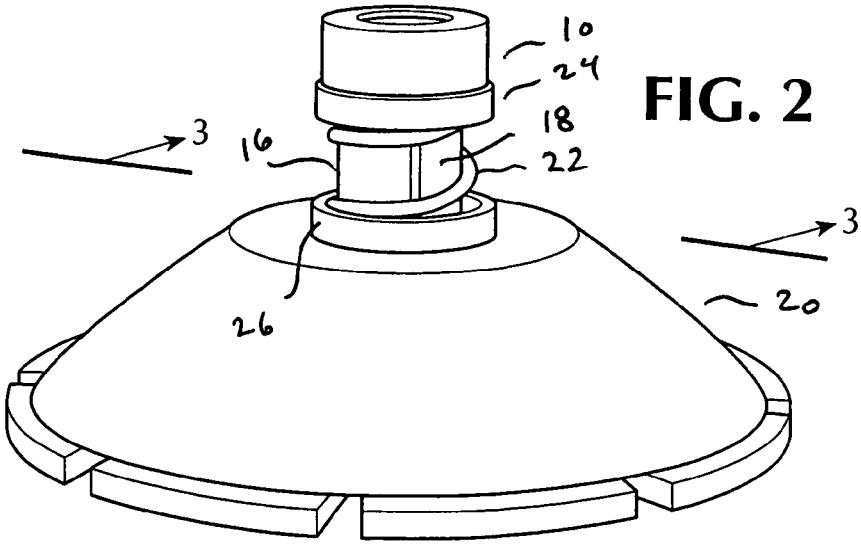
FIG. 2 is a perspective view of the invention with an installed blade.
Figure 3:
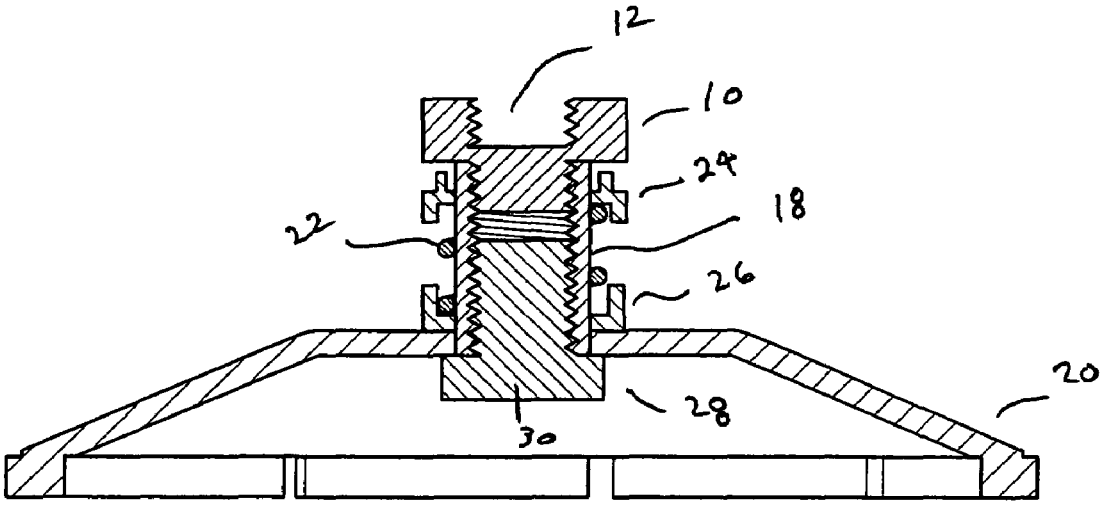
FIG. 3 is an elevational cross-section view thereof taken along line 3—3 of FIG. 2.

With initial reference to FIGS. 1–3, a power tool, such as an electric hand-held grinder (not depicted) has a rotating shaft or arbor member to which a blade, such as grinder cup blade 20, is mounted. The present invention provides a coupling between the blade and arbor shaft, and includes adaptor puck 10 that mounts upon the arbor shaft, typically through threaded bore 10 which allows the puck to be installed upon a correspondingly threaded portion of the power tool shaft. The puck 10 has a projecting threaded axle portion 14 extending from the puck body. The threads of the axle are preferably of the same pitch and diameter as the threads of the tool's shaft member. Blade-mounting stud 18, which is of polygonal and preferably square cross-section, has a threaded bore extending therethrough with threads complementary to the threads of the axle 14, such that the mounting stud can be affixed upon the axle, and thus serves as an extension of the arbor shaft. The face vertices or corners of the stud are threaded along their length 16 to allow the mounting of complementary elements on the stud. It is to be recognized that the puck 10 and blade mounting stud 18 may be formed as a unitary member. Alternatively, the stud may have a bore portion allowing the stud to be mountable directly upon the arbor shaft without an intermediate puck element.

Coiled compression spring 22 is mounted on the blade-mounting stud 18 between opposed inner and outer bowl washers 24 and 26, each of which has a central aperture to allow it to be mounted upon the stud. The aperture wall of the inner bowl washer 24 is circular, sized and threaded to mate with the stud threading, allowing the position of the washer along the length of the stud to be adjusted. The aperture of the outer bowl washer 26 is square, sized to allow the washer to slide freely upon the stud but without being able to rotate with respect to the stud.

The blade-mounting stud 18 is dimensioned to be received by the central circular mounting bore of bowl blade 20, which is of conventional construction. Blade retaining bolt 28 threads into the bore of the distal end of the mounting stud, its head 30 holding the blade upon the mounting stud.

FIGS. 2 and 3 depicts the coupler with the blade 20 mounted on the stud 18 in a normal operating position. The blade is located at the distal end of the stud, retained by the head 30 of retaining bolt 28 threaded into the stud, and is positioned between the bolt head 30 and the outer bowl washer 26. The outer bowl washer is urged against the blade by spring 22, the degree of force applied by the spring being controlled by the position of the inner bowl washer 24 along mounting stud 18. The uncompressed length of spring 22 may be such that, with the inner bowl washer 24 positioned adjacent the puck 10, the outer bowl washer 26 is not urged by the spring into a position along the mounting stud where it would conflict with the mounting of the blade on the stud. Once the blade is mounted upon the shaft the spring force applied to the blade through the outer bowl washer can be adjusted as appropriate by threading the inner bowl washer 24 along the stud as appropriate. Sufficient friction between the blade and outer bowl washer 26 and retaining bolt is present to drive the blade during use. The axial force applied by the spring to the outer bowl washer is chosen to allow the spring to further compress, absorbing excessive axial force applied to the blade by the user, and allowing the blade to move inwardly along the stud.

Figure 4:
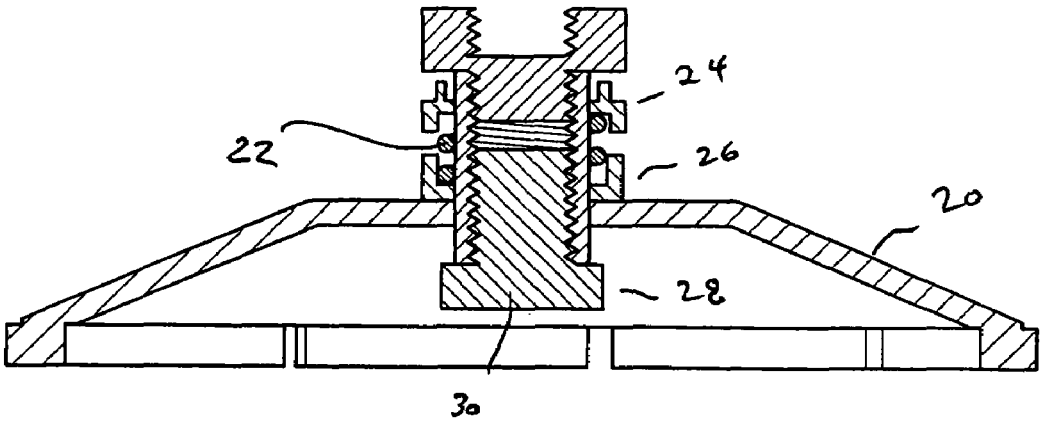
FIG. 4 is a corresponding elevational cross-section view showing the blade in a retracted position as when excessive force is applied to the tool.

FIG. 4 depicts the coupler when excessive operator axial force has been applied. Spring 22 is further compressed by the reaction force of the workpiece, the blade thus retracting upward along the stud 18 until the additional spring force resulting from the further compression matches the operator force. As the operator force varies, the degree of compression of the spring automatically compensates therefor, the blade moving back and forth along the stud. When the operator force returns to the proper level the blade returns to its normal position at the end of the stud, resting against the head of the retaining bolt 28. Because of the square cross-section of the shaft and the mating shape of the outer washer 26, the washer does not rotate, and thus remains in positive, fixed drive contact with the blade.

Oftentimes the body of a cup blade 20 is of an unhardened metal construction, and is relatively thin. Particularly when mounted to a square spindle slippage may occur, with resulting wear on the cup wheel body. This can lead to the need for blade replacement before the cutting edge is worn.

Figure 5:
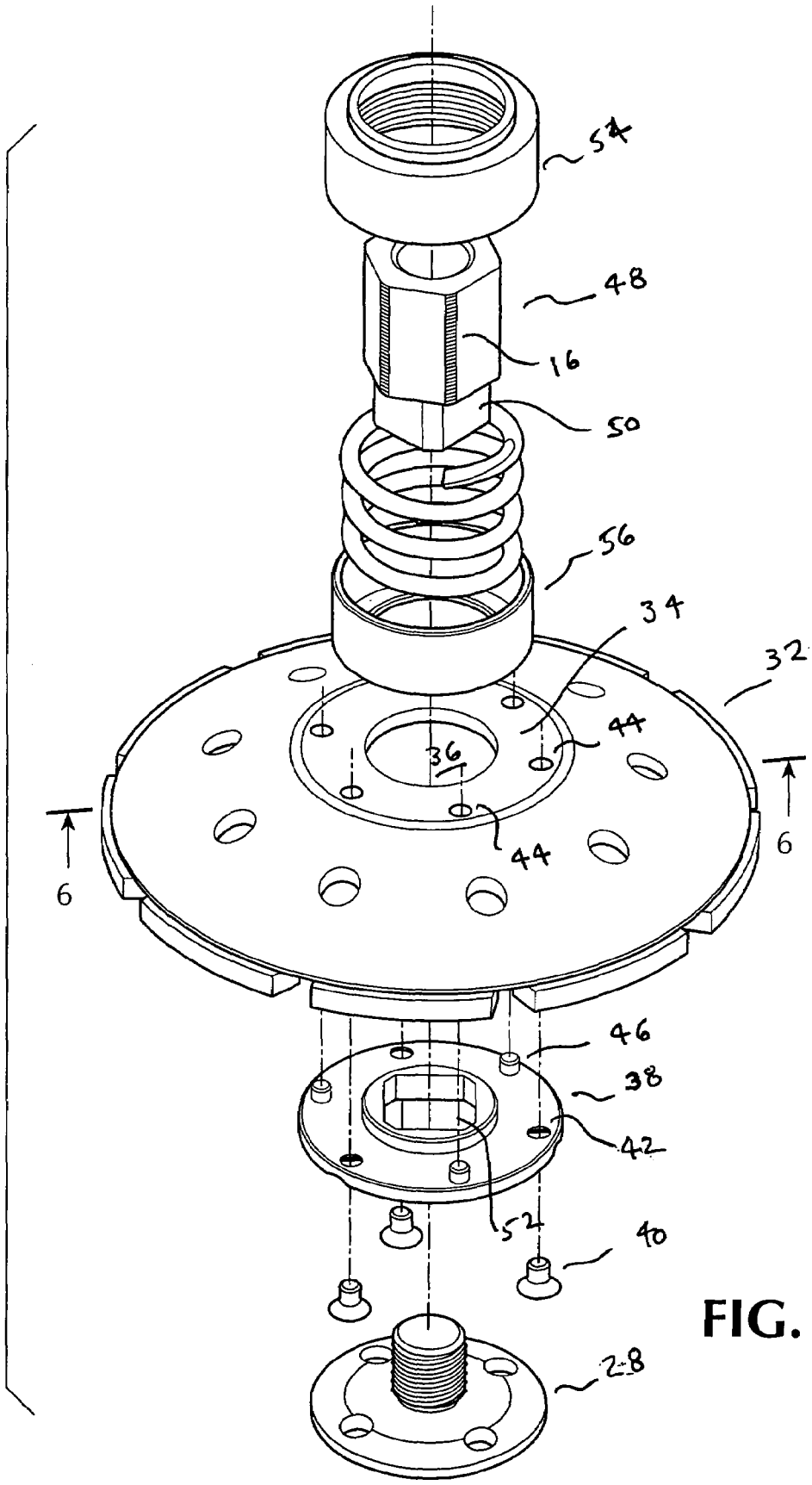
FIG. 5 is an exploded assembly diagram showing an alternative embodiment of the invention.
Figure 6:
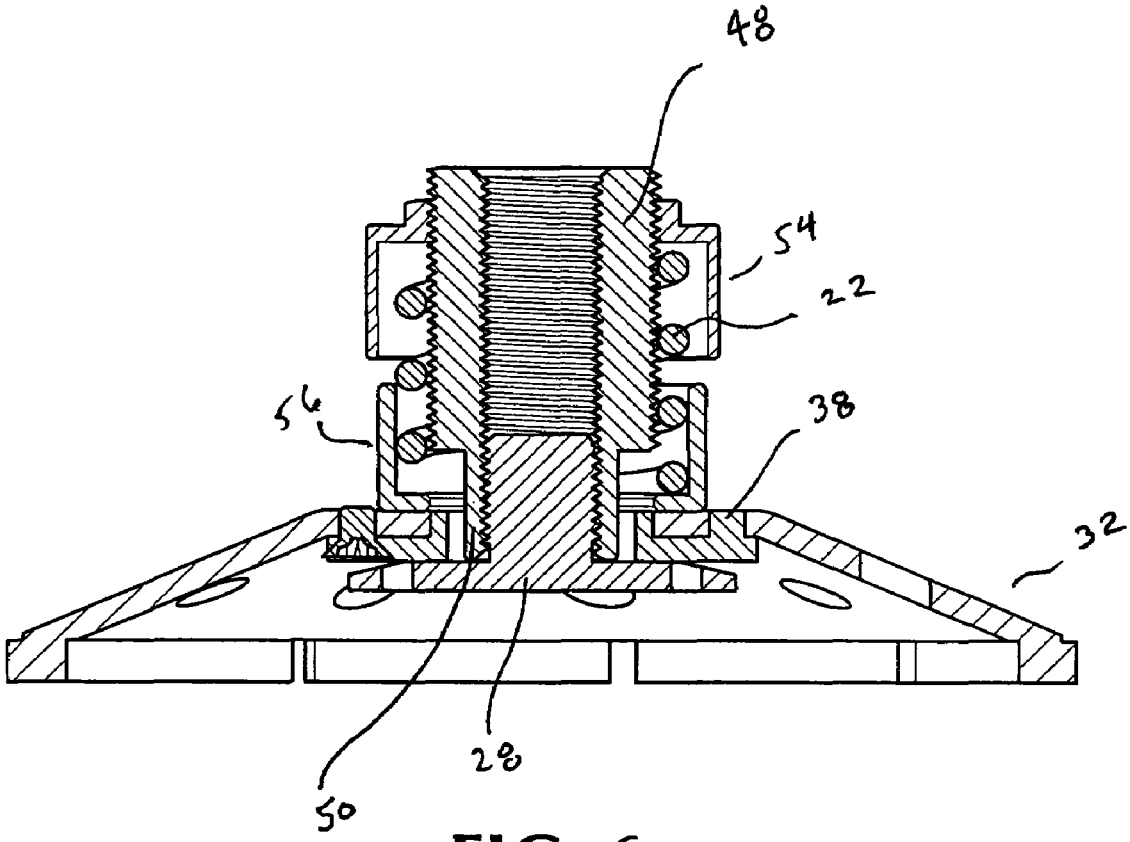
FIG. 6 is an elevational cross-section view thereof taken along line 6—6 of FIG. 5.

FIGS. 5 and 6 depict an alternative embodiment of the invention capable of resolving this problem. In this embodiment blade 32 is of a modified design, with an enlarged central planar section 34 surrounding the central mounting bore 36, which remains of standard size. Adaptor 38 mounts to the central section of the blade by screws 40, through adaptor mounting bores that thread into corresponding bores 44 in the central portion of the blade. The adaptor may be provided with studs 46 which engage other of the blade bores 44, and which assist in aligning the adaptor with the blade for mounting and also rigidify the adapter-blade connection. The adaptor eliminates the blade body-retaining bolt contact, and strengthens the blade body.

Blade-mounting stud 46 is multi-sided, and is shown with a main hexagonal portion having the thread surfaces 16 at the face vertices. An extension portion 48 is of reduced diameter, and may be of generally square cross-section, sized to accommodate the blade-mounting bore 36 and to be accommodated by the central mounting bore 50 of adaptor 38, which is of complementary shape and dimensions. Mounting stud 48 again has internal threading to allow it to be mounted either directly to a power tool arbor (not shown) or to an adaptor puck (also not shown). Inner and outer bowl washers 52, 54 function in the same manner as in the previous embodiment, inner washer being threaded to allow positioning along the stud 46. Outer washer 54, however, may have a circular mounting bore, as a non-slip connection between the blade 32 and the stud 46 is established through the mating of the sides if stud extension 48 and adaptor mounting bore 50. Blade retaining bolt 28 again retains the blade (and affixed adaptor 38) at the end of the stud 48. As in the prior embodiment adjustment of the inner bowl washer 52 varies the spring force applied to the blade, allowing the blade to retract along the stud when excessive axial force is applied to the blade by the user.

I claim:

1. A blade coupler for use with a power tool, comprising a blade mounting stud having means at a first end for connecting the stud to a motor shaft and means at an opposite, second end, for supporting a blade upon the stud in an axially-movable manner; a spring mounted on the stud for exerting a biasing force against the blade in a direction towards the second end; and means mounted to the stud for selectively varying the initial biasing force exerted by the spring against the blade.

2. The coupler of claim 1, wherein the means for selectively varying the initial biasing force comprises a washer threadably mounted upon the stud.

3. The coupler of claim 2, wherein the spring is located between the washer and a second washer mounted on the stud, the second washer transmitting the spring force to the blade.

4. The coupler of claim 3, wherein the means for supporting the blade is a mounting bolt removably threaded onto the second end of the stud.

5. The coupler of claim 2, wherein the stud has a polygonal portion upon which the washer is threaded.

6. The coupler of claim 5, wherein the second washer has a central aperture dimensioned to permit the washer to slide along a portion of the stud without rotating.

7. The coupler of claim 6, wherein the portion of the stud is the polygonal portion.

8. The coupler of claim 1, wherein the means for supporting the blade comprises an adapter mounted to the blade.

9. The coupler of claim 5, wherein the stud has a second portion upon which the blade is mounted.

10. The coupler of claim 9, wherein the second portion is of a lesser diameter than the polygonal portion.

11. The coupler of claim 10, wherein the second portion is of polygonal cross-section.

12. The coupler of claim 1, wherein the means for supporting the blade comprises an adapter having a central aperture dimensioned to fit upon the second stud portion without rotation thereof, the adapter being mounted to the blade.

* * * * *